US005190509A

United States Patent [19]

Davison, Jr.

[11] Patent Number: 5,190,509

[45] Date of Patent: Mar. 2, 1993

[54] UPPER BODY ISOLATING EXERCISER

[76] Inventor: Fredric O. Davison, Jr., 1719 Grant St., Santa Clara, Calif. 95050

[21] Appl. No.: 758,791

[22] Filed: Sep. 12, 1991

[51] Int. Cl.[5] ..... A63B 21/062

[52] U.S. Cl. ..... 482/100; 482/137; 482/142

[58] Field of Search ..... 482/99, 100, 102, 133, 482/136, 137, 138, 142, 908

[56] References Cited

U.S. PATENT DOCUMENTS

| | | | |
|---|---|---|---|
| 2,632,645 | 3/1953 | Barkschat | 482/102 X |
| 3,640,527 | 2/1972 | Proctor | 482/137 X |
| 3,708,166 | 1/1973 | Annas | 482/137 X |
| 3,912,261 | 10/1975 | Lambert, Sr. | 482/136 X |
| 4,125,258 | 11/1978 | McArthur | 482/136 X |
| 4,240,627 | 12/1980 | Brentham | 482/138 X |
| 4,254,950 | 3/1981 | Baumann | 482/138 X |
| 4,482,152 | 11/1984 | Wolff | 482/137 X |
| 4,505,475 | 3/1985 | Olschansky et al. | 482/138 X |
| 4,541,628 | 9/1985 | Parviainen | 482/100 X |
| 4,600,189 | 7/1986 | Olschansky et al. | 482/137 X |
| 4,635,933 | 1/1987 | Schnell | 482/137 X |
| 4,746,115 | 5/1988 | Lahman | 482/138 X |
| 4,757,992 | 7/1988 | Heitsch et al. | 482/136 |
| 4,799,670 | 1/1989 | Williamson | 482/136 X |
| 4,844,456 | 7/1989 | Habing et al. | 482/100 |
| 4,907,798 | 3/1990 | Burchatz | 482/99 |
| 4,949,951 | 8/1990 | Deola | 482/138 |
| 4,953,855 | 9/1990 | Shields | 482/99 |

FOREIGN PATENT DOCUMENTS

| | | | |
|---|---|---|---|
| 2581550 | 11/1986 | France | 482/137 |
| 8501446 | 4/1985 | PCT Int'l Appl. | 482/137 |

*Primary Examiner*—Robert Bahr

*Attorney, Agent, or Firm*—Robert Samuel Smith

[57] ABSTRACT

An exerciser for the upper body including a frame supporting a seat whose position can be adjusted in the vertical direction, a weight assembly slidably mounted on a vertical track, an overhead cam assembly coupled by a cable to the weight assembly and which is turned by a seated user forcibly contacting a lever arrangement adjustably secured to the cam assembly. By adjustably orienting the lever on the cam, different starting positions for the exercises are provided enabling the user to perform forward forearm presses or rearward forearm presses. A second cam system has a pair of double cams, one on the right side and one on the left side of the seated user. Each double cam is coupled to the weight stack by a cable having a pair of branches on each end. One branch cable member is attached to the periphery of one cam of the double cam and the other branch member is attached to the periphery of the second cam of the double cam providing that resistance is applied by turning the double cam in either direction. By shifting the seat to the appropriate height, lateral extensions, tricep extensions, curls and deltoid extensions can be performed.

15 Claims, 2 Drawing Sheets

FIG. 3
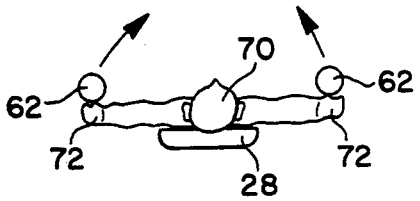
FIG. 4
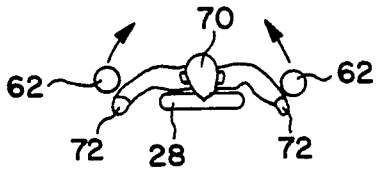
FIG. 5
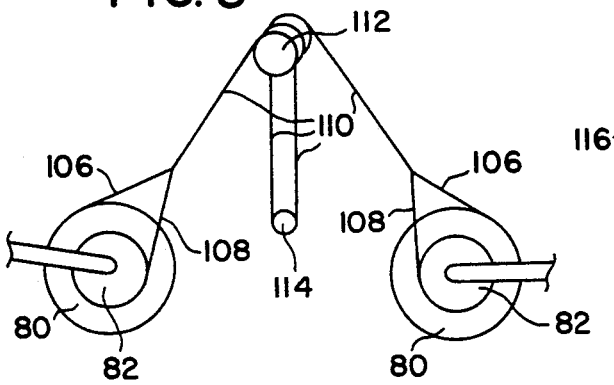
FIG. 6
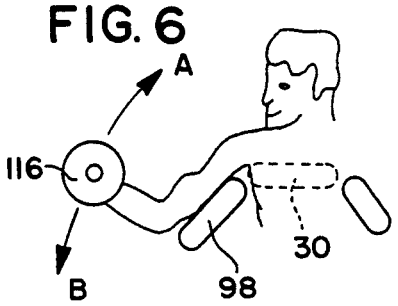
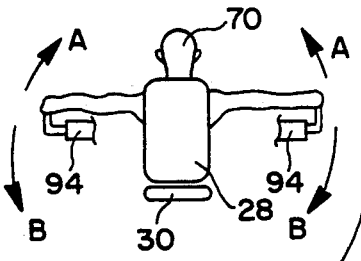
FIG. 7
FIG. 2
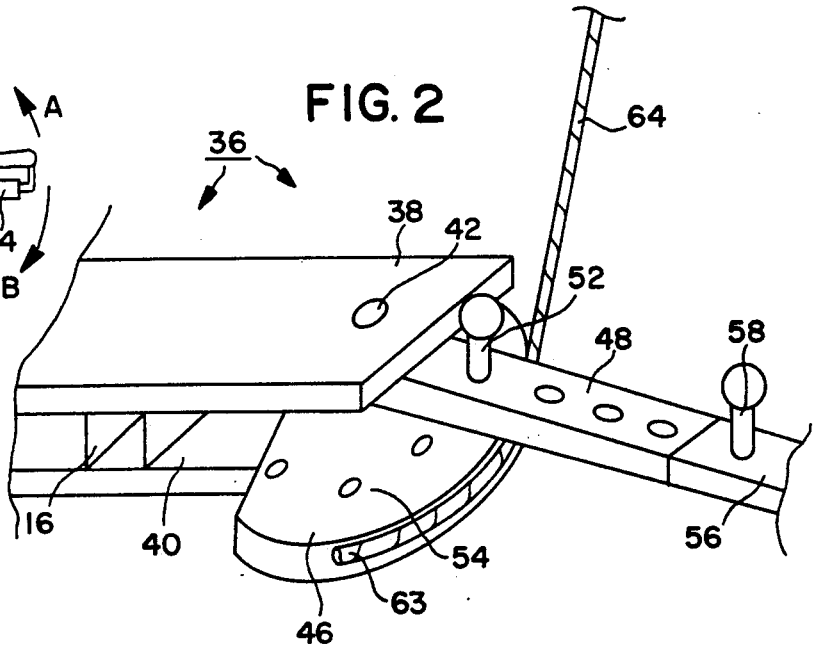

UPPER BODY ISOLATING EXERCISER

FIELD OF THE INVENTION

This invention relates to exercise apparatus for the upper body and particularly to an exerciser of the type having a frame supporting vertically sliding adjustable weights attached to one end of a cable whose other end is attached to several lever members which a seated user grasps and turns in the performance of a variety of exercises.

BACKGROUND AND INFORMATION DISCLOSURE STATEMENT

Exercise apparatus incorporating the use of weights attached to one end of a cable that passes over a system of pulleys to handles grasped by a user have been built in a number of forms for many years. This type of apparatus has been particularly popular for performing exercises to develop the upper body.

The first apparatus of this type included a cable passing over a single pulley with the user standing with either his back toward the pulley so that he could push on the handles to exercise his chest muscles or his chest toward the pulley so that he could pull on the handles to exercise his upper back muscles.

Motivation to add to the repertoire of exercise came from increased interest in body contact sports, particularly football, where greater strength of the shoulders and neck was desired for blocking and tackling.

A new type of upper body machine was disclosed in U.S. Pat. No. 4,757,992 to Heitsch et al for an apparatus in which the user sat on a bench with a backrest to stabilize the body while he grasped a handle in each hand with his forearms against pads and performed a hugging motion (brought his arms across his chest) to develop the muscles of the chest. The handles were on the end of a pair of levers whose resistance to turning was provided by a cam with the end of a cable attached to its periphery and whose other end passed over a pulley to an adjustable stack of weights sliding on a vertical track.

U.S. Pat. No. 4,844,456 to Habing et al discloses an exercise apparatus including one station with a seat and backrest and a lever with handles for pushing to perform presses from the chest The seat and back support are in a fixed vertical position on a vertical column however the inclination of the back support is adjustable. A second seat with backrest and pads for performing shoulder presses is provided.

In the type of exerciser described in the foregoing paragraphs, a common characteristic of the construction is slidable positioning of one member on another member such as when two tubes telescope together In such instances common practice is to detachably lock the two members together by devices known as popit pins. A popit pin is a pin that is slidably secured to one member and is spring loaded to pass engagingly into one of a plurality of holes in the second member. The popit pin is available from a number of sources including the Spartan Manufacturing Co., Grant Street, Santa Clara, Calif.

Another type of exerciser used to develop the arms and shoulders is the barbell used with an arm support at the elbows which stabilizes the arm while the user performs "curls". Stabilizing the arm in this manner confines the major stress (isolates) on the biceps.

The exercises described in the foregoing paragraphs illustrate that all around development of the arms and shoulders requires performing motions in a number of degrees of freedom and that, in any given exercise, the ability to stabilize part of the body, e.g., using a backrest to perform presses from the chest or elbow support when performing curls, is an important requirement to "isolating" on a particular muscle group in order to obtain maximum rate of strength increase.

THE INVENTION

Objects

It is an object of this invention to provide an apparatus having one exercise station from which the user can perform numerous exercises to develop the upper body. These exercises include forward forearm presses to develop muscles of the chest, rearward forearm presses to develop muscles of the upper back, curls in which the elbow is supported to develop the biceps, tricep extensions in which the elbow is supported to develop the triceps.

It is another object that, in performing any of these exercises, the starting position can be preset so that the range of motion can be varied depending on the size of the user.

It is another object that support of the chest, back or elbows in each respective exercise be provided to effectively isolate on the particular muscle group perfoming the exercise.

Summary

This invention is directed toward an exercise apparatus which features:

a branched cable-double cam arrangement that provides resistance to both directions of rotation of a lever attached to the double cam;

adjustable preset starting orientation of levers attached to cams thereby increasing the number of exercises that can be performed;

vertical seat positioning to permit performance of a greater number of exercises.

The exercise apparatus of this invention includes a frame supporting a vertical track on which a stack of weights slides. The frame also supports a seat with a vertical padded rest on which a user may sit with his back against the rest. In this position he may extend each arm to the side and press with his forearms against a pair of pads to perform forward forearm presses by bringing his elbows toward one another thereby exercising the muscles of the chest.

Alternatively, the user may straddle the seat with his chest against the vertical padded rest. In this position he may extend his arms to the sides and press with his forearms against the pads to perform rearward forearm presses thereby exercising the muscles of the upper back.

Each pad is mounted on the end of lever detachably pinned to a cam which is coupled by a cable through overhead pulleys to the weights.

The length of the lever arms and vertical position of the seat are adjustable depending on the size of the user.

Two more lower levers are provided, each mounted on a side of the seat opposite the other lever. Each lower lever has a pair of cams to which it is detachably pinned. One cam is attached to one branch of a cable and the other cam is attached to another branch of the same cable whose other end passes over a pulley to the weight stack. Therefore, resistance is applied in both directions to turning the lever thereby enabling the user to perform curls by pressing the lever in one direction or tricep extensions by pressing the lever in the opposite direction. The length of the lever arm is adjustable according to the size of the user. The orientation at which the lever is pinned to the cam is adjustable so that the starting position of the exercise can be preset according to the requirements of the user. A removable elbow support is provided for satabilizing the upper arm thereby providing better isolation in performing the exercise.

DRAWINGS

FIG. 2 shows details of the upper cam assembly.

FIG. 3 shows a top view of a user performing the forward forearm press.

FIG. 4 shows a top view of the user performing the rearward forearm press.

FIG. 5 shows the pulley arrangement for the double cam assembly.

FIG. 6 shows the user performing curls or tricep extensions.

FIG. 7 is a rear view of a user performing extensions of the deltoids and latissimus dorsi.

DESCRIPTION OF A PREFERRED EMBODIMENT

Figure 1:
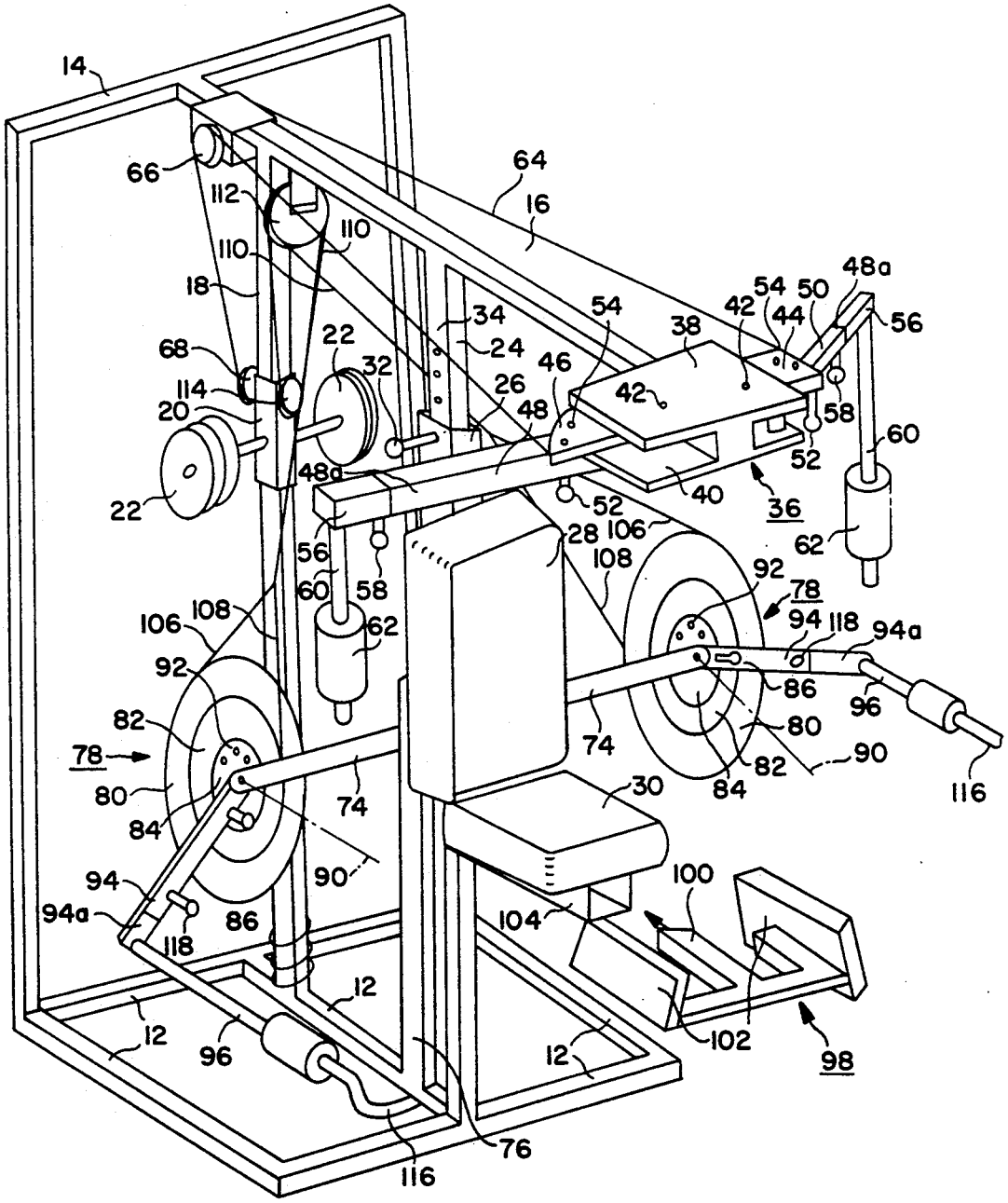
FIG. 1 is a view in perspective of the upper body exerciser of this invention.

The following detailed description illustrates the invention by way of example and not by way of limitation of principles of the invention. This invention will clearly enable one skilled in the art to make and use the invention and includes several embodiments including what I presently believe is the best mode for carrying out the invention.

Turning now to a discussion of the drawings, FIG. 1 shows a perspective view of the exerciser of this invention. including a frame of lower horizontal members 12 and upper horizontal member 14, to which one end of strut 16 is attached. Upper strut 16 supports the upper end of vertical track 18 on which weight assembly 20 with changeable weights 22 is slidably mounted. Upper strut 16 also supports the upper end of vertical seat support member 24 on which is slidably mounted tube 26 to which is attached vertical rest 28 and seat 30. Tube 26 may be fixed in its position on seat support member 24 by poppit pin 32 engaging one of the holes 34 in vertical seat support member 24.

An upper cam assembly 36, is mounted on the end of horizontal upper strut 16. One half of the assembly, partially cut away, is shown to best advantage in FIG. 2. Upper cam assembly 36 includes a top plate 38 and a bottom plate 40 secured to the end of strut 16. Two shafts 42, one on each side of upper strut 16 through plates 38 and 40, support cams 44 or 46 and one end of lever 50 or 48 respectively.

Orientation of each upper lever 50 or 48 with respect to its respective upper cam 44 or 46 is adjustably fixed by popit pins 52 through the respective lever which engage one of several holes 54 in respective cam 44 or 46. Each upper lever 48 or 50 has a telescoping member 56 fixed with popit pins 58 that telescopes into a base section 48*a* thereby permitting extension of the lever arms.

As shown in FIG. 1, each lever 48 or 50 has a handle bar 60 with pads 62.

Cable ends 63 and 65 of cable 64 are attached to the peripheries of upper cams 46 and 44 respectively. As shown in FIG. 1, cable 64 passes over double anchor pulley 66 and loops around weight pulley 68 attached to weight assembly 20.

As shown in top view FIG. 3, the user 70 may sit on the seat 30 with his back against vertical pad support 28, place his forearms 72 against pads 62 and perform forward arm presses by bringing his arms together across his chest as shown by the arrows thereby exercising the muscles of the chest.

Alternatively, as shown in top view FIG. 4, the user 70 may sit with his chest against the vertical pad support 28 with the back of his forearms 72 against pads 62 and perform rearward forearm presses by forcing the pads toward his back as indicated by the arrows thereby exercising the muscles of the upper back.

These starting positions are preset by appropriate orientation of the upper levers 48 and 50 fixed by popit pins 52 engaging cams 44 and 46 as discussed above and shown in FIG. 1 and 2.

FIG. 1 shows a lower strut 74 supported by vertical member 76. Two lower double cam assemblies 78 are shown, each rotatably mounted on opposite ends of lower strut 74. Each lower double cam assembly 78 includes large cam 80, small cam 82, and disk 84, all concentrically mounted on the end of lower strut 74 to rotate together about center line 90. Lower levers 94 each have an end rotatably mounted on the respective centerlines 90 of the lower cam assemblies 78 so that levers 94 may be oriented about center lines 90 and then fixed to respective cam assembly 78 by respective popit pin 86 engaging one of holes 92 in disk 84. The free end of each lever 94 is attached to an end of a handle bar 96 which are padded by pads 98.

An elbow support assembly 98 includes an E frame 100, supporting elbow pads 102, and telescopes into horizontal seat support 104.

Shown to best advantage in FIG. 5, the ends of branch cables 106 and 108 are secured to the peripheries of cams 80 and 82 respectively on each double cam assembly. Cables 106 and 108 are branches of cable 110 which pass over double pulley 112 and loop around pulley 114 on the weight stack assembly 20.

The branched cable arrangement (106, 108 and 110) provides that resistance to turning the levers 94 is imposed in both directions of rotation of the lever. Cam 82 is larger and therefore more difficult to turn than cam 80 to compensate for the fact that the force of the triceps pushing downward (rotation in one direction) is aided by the weight of the arm added to the weight of the adjustable lever arm whereas the weight of the arm and lever resists rotation in the opposite direction.

Therefore, as shown in FIG. 6 and referring to FIG. 1, a user may rest his elbow on elbow rest assembly 98 and grasp the handle 116 of handle bar 96 to perform curls, by rotating the lever 94 in one direction indicated by arrow A, or he may push down on the padded bar 96 to perform tricep extensions by rotating the lever 94 in the opposite direction arrow B. The starting position for each exercise can be preset by orienting lever 94 and then securing it to disk 92 with popit pin 86 engaging a hole 92 in disk 84.

FIG. 7 is a view looking at the rear of the user illustrating additional exercises. The seat 30 and back support 28 are lowered to a position where the lower strut 74 (not shown in FIG. 8) is in the same elevation as the user's shoulders. The length of the lever 94 (partially cut away in FIG. 8) can be adjusted by telescoping section 94*a* and secured by popit pin 118 as discussed with reference to FIG. 1.

The user rotates the lever 94 in an upward direction (arrow A) to exercise the deltoids and rotates the lever 94 in the downward direction (arrow B) to exercise the latissimus dorsi.

A useful feature of the double cam arrangement is not only the provision of resistance in both directions of rotation of the lever, but also a difference in magnitude of resistance by virtue of the difference in the diameters of the two cams in each double cam assembly.

In the foregoing paragraphs, an exerciser for the upper body has been described which meets the objects of this invention. The exerciser can be used to perform six exercises that address the major muscle groups of the upper body. These exercises include curls, tricep extensions, forewrd and rearward forearm presses, deltoid and latissimus dorsi contractions. This has been accomplished with a novel double cam arrangement and vertical adjustment of the seat. A single weight stack assembly provides adjustable resistance to all the exercises. A single seat station is provided and the single station feature reduces floor space requirements as compared to multistation apparatus. A branched cable arrangement provides resistance in two directions of rotation of a lever for performing, e.g., curls and tricep extensions. Starting positions and lengths of levers may be preset depending on the size of the user.

The starting position of the levers may be preset in one position for performing one exercise and in another position for performing a complementary exercise, e.g., forward forearm presses and rearward forearm presses.

It should be understood that various modifications within the scope of this invention can be made by one having ordinary skill in the art without departing from the spirit thereof. For example, a branched cable arrangement could be incorporated into both cam assemblies. The position of the lower strut could be vertically adjustable with respect to the seat rather than vice versa as disclosed. I therefore wish my invention to be defined by the scope of the appended claims and in view of the specification if need be.

I claim:

1. An exerciser for exercising the upper body of a user which comprises:

a frame including a vertical track member and vertical seat support member;

a weight assembly means slidably mounted on said vertical track;

a seat means slidably mounted on said vertical seat support member;

means for securing said seat means at any one of a plurality of preset locations on said vertical support member;

a right and left lower lever means rotatably secured to said frame for exercising by a user sitting on said seat with said right lower means located on his right side and said left lower means located on his left side;

a first cable means having a first end coupled to said right lower lever means and a second end coupled to said left lower lever means;

a first pulley means for coupling said weight means to said first cable means; and wherein said right and left lever means each includes:

a first lower cam and second lower cam, each with a periphery;

an arm;

said first and second cams and an end of said arm concentrically mounted rotatably together on said frame;

means for securing said arm to a preset orientation with respect to said cams; and said first cable means includes a first branch cable and a second branch cable each having one end joined to said periphery of said first and second cams respectively at locations on opposite ends of a diameter of said cams and each said branch cable having another end joined to said another branch cable end and to an end of a main cable coupled to said weight assembly means providing that when said lower lever is turned in one said direction, said first cam will pull on said first branch cable and when said lever is turned in said opposite direction, said second cam will pull on said second branch thereby lifting said weight means and providing resistance to turning said lever in both said directions to a user seated at a preset elevation on said seat and forcibly contacting said right or left lower lever means with his respective right or left hand or forearm to rotate said respective lower lever means.

2. An exerciser as in claim 1 wherein said first pulley means comprises:

a pair of first anchor pulleys rotatably attached to said frame adjacent to a top end of said vertical track member;

a first weight pulley rotatably mounted on said weight means providing that said main cable may loop around said first weight pulley providing two main cable sections, each main cabie section passing over one of said first anchor pulleys and each main cable section having an end attached to respective ends of said cable branches.

3. An exerciser as in claim 1 wherein said arm comprises:

a secured section having one end rotatably mounted on said frame member and another end which receivingly engages one end of a telescoping section whose other end is secured to a handle means;

a means for securing said telescoping section in one of a plurality of preset positions on said secured section thereby providing that length of said arm may be adjusted in accordance with size of said user.

4. An exerciser as in claim 3 wherein said handle means includes:

a bar means having one end secured to said end of said telescoping section and a bent end;

a pad positioned on said bar means.

5. An exerciser as in claim 4 wherein said horizontal pad support is tubular with an open end and said exerciser comprises:

an E frame including two parallel pad support legs and a central leg, all three legs parallel to one another and attached to a connecting leg with said central leg between said parallel legs;

two pads, one said pad on each pad support leg providing that said central leg may telescope into said open end of said pad support thereby providing an elbow rest for a user to grasp said lever means to perform curls and tricep extensions.

6. An exerciser as in claim 1 wherein said seat means comprises:

a first tubular member slidably mounted on said vertical seat support member;

a horizontal pad support having a first end attached to said first tubular member;

a seat pad secured to said pad support;

a vertical pad attached to said first tubular member in operable arrangement with said seat pad to permit a user to sit on said seat pad with his back contacting said vertical pad or to permit said use to straddle said seat pad with his chest contacting said vertical pad.

7. An exerciser as in claim 6 wherein said vertical seat support member has an elongated side with a hole at each said preset location and said securing means includes a popit pin secured to said first tubular member in operable arrangement with said vertical seat support means to align with any one of said holes in said vertical support member.

8. An exerciser as in claim 1 wherein said lower cam has a flat surface with holes arranged circumferentially on said surface and said means for detachably securing said arm to said first cam includes a popit pin secured to said arm and operably arranged with said first cam to engage one of said holes when said arm is rotated to said required orientation.

9. An exerciser for exercising the upper body of a user which comprises:

a frame including a vertical track member, a vertical seat support member and an overhead strut member supported by ends of said vertical track and seat support members and having an end;

a weight assembly means slidably mounted on said vertical track;

a seat means slidably mounted on said vertical seat support member;

said frame end extending over said seat means;

means for securing said seat means at any one of a plurality of preset locations on said vertical support member;

a right and left lower lever means rotatably secured to said frame for exercising by a user seated on said seat with his right lower lever means located on his right side and said lower lever means located on his left side;

a first cable means having a first end coupled to said right lower lever means and a second end coupled to said left lower lever means;

a first pulley means for coupling said weight means to said first cable means thereby providing that resistance to rotation of said lower lever means may be applied and providing that said user may preset elevation of said seat depending on his selection of exercise and then sit on said seat means to perform said exercise by forcibly contacting said right or left means with his respective right or left hand or forearm to rotate said respective lower lever;

a right upper cam means with a right cam periphery and a left upper cam means with a left cam periphery;

means to mount each right and left upper cam on said strut end to rotate about respective right and left vertical centerlines adjacent to said strut end;

a second cable means having one end secured to said right cam periphery and another end secured to said left cam periphery;

a second pulley means for coupling said second cable means to said weight assembly means thereby providing that when said right and left cam is turned, said second cable means lifts said weight assembly means;

upper right and left lever means, each mounted perpendicular to said respective right and left centerline and each mounted at an end to rotate about said right and left centerline respectively;

means to detachably secure said upper lever means to said upper cam thereby providing that a user may preset an orientation of said upper lever means with respect to said respective right and left cam, sit on said seat means and exercise by forcibly contacting his arms or fore arms against said lever means and rotating said lever means.

10. A device as in claim 9 wherein each said right and left upper lever means comprise:

a base section having said rotatably mounted end mounted to rotate about said upper cam centerline and a second base section end;

a telescoping section having a telescoping end that telescopes onto said second base section end and a free end;

means for detachably securing said telescoping section in any one of a plurality of locations on said base section;

a handle means on said free end which said seated user forcibly contacts to perform said exercises.

11. An exerciser as in claim 10 wherein said base section has an elongated surface with a plurality of aligned holes and said securing means comprises a popit pin secured to said telescoping section and arranged in operable combination with said base section to selectively engage any one of said holes in said base section thereby providing that said telescoping section is detachably secured on said base section permitting said user to adjust a length of said upper lever means.

12. An exerciser as described in claim 10 wherein said handle means comprises:

a handle bar perpendicularly attached at one end to said free end and oriented into a position within the reach of said seated user;

a pad on said bar.

13. An exerciser as in claim 10 wherein said base section has a plurality of aligned holes and said telescoping securing means comprise a popit pin secured to said telescoping section and operably arranged in combination with said base section to engage any one of said holes in said base section.

14. An exerciser as in claim 9 wherein said second pulley means comprises:

a second pair of anchor pulleys rotatably mounted adjacent to a top end of said vertical track member;

a second weight pulley rotatably mounted on said weight assembly means providing that said second cable may loop around said second weight pulley forming two second cable sections, with said section passing over one of said second anchor pulleys and having an end secured to a respective one of said upper cam peripheries.

15. An exerciser as in claim 9 wherein each said upper cam has flat surface with a plurality of holes located circumferentially on said surface about said centerline and said means for detachably securing said respective upper lever means to said upper cam means in a popit pin secured to said lever means and operably arranged to pass through any one of said locating holes when said lever is oriented with respect to said cam with said hole aligned with said popit pin.

* * * * *